US008490716B2

(12) United States Patent
Nyström

(10) Patent No.: US 8,490,716 B2
(45) Date of Patent: Jul. 23, 2013

(54) ROCK DRILLING DEVICE AND ROCK DRILLING RIG OR ROCK BOLTING RIG COMPRISING SUCH DEVICE

(75) Inventor: Sven-Olov Nyström, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 264 days.

(21) Appl. No.: 12/736,648

(22) PCT Filed: May 11, 2009

(86) PCT No.: PCT/SE2009/000240

§ 371 (c)(1),
(2), (4) Date: Oct. 26, 2010

(87) PCT Pub. No.: WO2009/136841

PCT Pub. Date: Nov. 12, 2009

(65) Prior Publication Data

US 2011/0036608 A1 Feb. 17, 2011

(30) Foreign Application Priority Data

May 9, 2008 (SE) ..... 0801049

(51) Int. Cl.
*E21B 15/04* (2006.01)

(52) U.S. Cl.
USPC ..... 173/185; 173/184; 173/171

(58) Field of Classification Search
USPC ..... 173/185, 184, 171
See application file for complete search history.

(56) References Cited

U.S. PATENT DOCUMENTS

| | | | | |
|---|---|---|---|---|
| 3,729,056 | A | 4/1973 | Paurat | |
| 3,797,587 | A | 3/1974 | Klein | |
| 3,999,805 | A | 12/1976 | Lockwood | |
| 4,069,877 | A | 1/1978 | Durand | |
| 4,251,046 | A | 2/1981 | Walmsley et al. | |
| 4,456,077 | A | 6/1984 | Lagerstedt et al. | |
| 5,241,792 | A * | 9/1993 | Naka et al. | 451/24 |
| 5,310,011 | A * | 5/1994 | Kaakkurivaara | 173/194 |
| 5,556,217 | A * | 9/1996 | Deyo et al. | 403/61 |

(Continued)

FOREIGN PATENT DOCUMENTS

| | | |
|---|---|---|
| EP | 0140873 A1 | 5/1985 |
| EP | 1696100 A1 | 8/2006 |

(Continued)

*Primary Examiner* — Brian D Nash
(74) *Attorney, Agent, or Firm* — Mark P. Stone

(57) ABSTRACT

A boom arrangement (202) and a drilling rig having the boom arrangement for use in a mining or construction machine (200) the boom arrangement having a first boom section (203) with a first and a second end, in which the first end is designed to be fastened to a carrier (201), and the second end is designed to carry a drilling machine (210), the boom arrangement (202) also having a first rotational linking element (205) with a first axis of rotation (B1) and a second rotational linking element (206) with a second axis of rotation (B2). The first rotational linking element (205) is arranged at the first end of said first boom section (203) and the second rotational linking element (206) is arranged at said second end of the first boom section (203) such that the axes of rotation (B1, B2) are fixed in relation to each other, and the axes of rotation (B1, B2) form angles with vertical direction of the carrier, the angles being in the interval of 0 to 45°.

19 Claims, 6 Drawing Sheets

U.S. PATENT DOCUMENTS

| | | | | |
|---|---|---|---|---|
| 5,558,169 | A * | 9/1996 | Madgwick et al. | 173/185 |
| 5,568,997 | A * | 10/1996 | Raunisto | 405/232 |
| 5,626,457 | A * | 5/1997 | Hickman, Jr. | 414/739 |
| 5,913,573 | A | 6/1999 | Schlegl et al. | |
| 6,105,684 | A | 8/2000 | Pointer et al. | |
| RE37,661 | E * | 4/2002 | Raunisto | 405/232 |
| 6,550,544 | B1 | 4/2003 | Saf | |
| 6,672,410 | B2 | 1/2004 | Smith | |
| 6,698,978 | B2 * | 3/2004 | Albertson et al. | 405/148 |
| 6,814,155 | B1 | 11/2004 | Nielson et al. | |
| 6,871,710 | B1 * | 3/2005 | Darling et al. | 173/184 |
| 7,032,686 | B2 | 4/2006 | Barthomeuf et al. | |
| 2003/0208207 | A1 * | 11/2003 | Layer | 606/130 |
| 2004/0111183 | A1 * | 6/2004 | Sutherland et al. | 700/245 |
| 2005/0103509 | A1 | 5/2005 | Barthomeuf et al. | |
| 2005/0129466 | A1 | 6/2005 | Walker et al. | |
| 2006/0278419 | A1 * | 12/2006 | Hinshaw et al. | 173/184 |
| 2011/0187036 | A1 * | 8/2011 | Duval | 267/177 |

FOREIGN PATENT DOCUMENTS

| | | |
|---|---|---|
| GB | 1482093 | 8/1977 |
| GB | 1498585 | 1/1978 |
| JP | 2005240517 | 9/2005 |
| WO | WO 96/07014 A1 | 3/1996 |
| WO | WO 99/61748 A1 | 12/1999 |
| WO | WO 02/103162 A1 | 12/2002 |

* cited by examiner

PRIOR ART

ROCK DRILLING DEVICE AND ROCK DRILLING RIG OR ROCK BOLTING RIG COMPRISING SUCH DEVICE

FIELD OF THE INVENTION

The present invention relates to a boom arrangement for use in drilling or bolting. In particular, the present invention pertains to a boom arrangement, and to a rock drilling or rock bolting rig including the boom arrangement.

BACKGROUND OF THE INVENTION

In rock drilling and rock bolting, one often uses a rock drilling rig where one or more drilling machines are borne by respective movable arms, or booms.

Depending on the type of drilling, such as tunneling or ore mining, different types of rock drilling rigs are used. For example, when driving a tunnel, one often uses large machines with a plurality of booms, so as to drill a plurality of holes at the same time, or nearly so, and to reach across the entire, usually broad cross sectional surface that the tunnel requires from a single supporting position.

In ore mining, on the other hand, it is often desirable for economic reasons to mine the ore in such a way that only the ore body is mined, thereby reducing as much as possible the amount of excess rock that needs to be handled. This means that, when mining small ore bodies and/or when only a small portion of the ore body contains the desired ore, the mining can occur at very low gallery heights, with corresponding requirements for the rock drilling rig.

Thus, different situations place different requirements on the rock drilling rig, and therefore rock drilling rigs occur in many different designs, and hence also with many different types of booms.

A boom usually consists of an elongated structure, whose one end is normally secured to a supporting element, such as a vehicle, by one or more links. Moreover, a drilling machine is usually hinged to the end of the boom away from the support via one or more additional links.

However, the drilling machine is usually not attached directly to the boom, but instead is normally displaceable attached to the boom via a feeding arrangement consisting of a feed holder, which carries a feed beam arranged displaceable relative the feed holder, and furthermore the drilling machine can usually move relative to the feed beam so as to achieve good freedom of adjustment during drilling without the need for the supporting element to have to move.

Even though booms of the above type work well in many applications, it can be difficult to create a boom that simultaneously fulfils both needs and/or requirements on rig mobility and maneuverability when drilling in a desired manner, especially for rock drilling rigs designed for very narrow galleries. Therefore, there is a need for an improved boom for use particularly with rock drilling rigs designed to work at low gallery height.

SUMMARY OF THE INVENTION

The purpose of the present invention is to provide a boom arrangement for a mining and/or construction machine which solves the above problem. This purpose is accomplished with a boom arrangement according to claim 1.

The present invention involves a boom arrangement for use in a mining and/or construction machine, comprising a first boom section with a first and a second end, wherein said first end is designed to be fastened to a carrier, and said second end is designed to carry a drilling machine, wherein said boom arrangement furthermore comprises a first rotational linking means with a first axis of rotation and a second rotational linking means with a second axis of rotation. Said first rotational linking means is arranged at said first end of said first boom section and said second rotational linking means is arranged at said second end of said first boom section such that said axes of rotation are fixed in relation to each other, and said axes of rotation make angles with a vertical direction, said angles being in the interval of 0 to 45°.

The present invention has the benefit, thanks to said axes of rotation being fixed in relation to each other, and forming respective angles with a vertical direction in the interval of 0 to 45°, that a boom arrangement can be produced that not only enables good reach for drilling/bolting, but also enables a compact rock drilling rig for moving around. Such an arrangement is especially useful in rock drilling rigs designed to work at low gallery height, since when such rigs move around there is a high risk of some portion of the boom or the feed arrangement with the drilling machine hitting the surrounding rock.

The invention also pertains to a rock drilling and/or rock bolting rig.

DETAILED DESCRIPTION OF SAMPLE EMBODIMENTS

Figure 1:
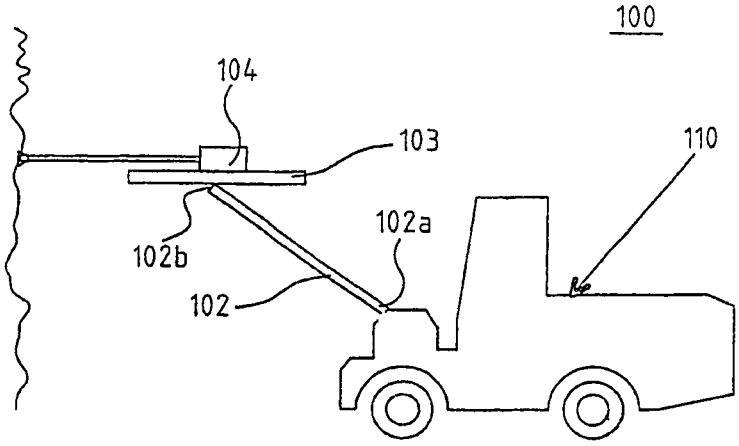
FIG. 1 shows a customary rock drilling rig for drilling and/or rock bolting.

FIG. 1 shows a mining machine in the form of a customary rock drilling rig 100. The rig 100 comprises a boom 102, whose one end 102*a* is fastened to a (schematically indicated) carrier 110, such as a vehicle, and whose other end 102*b* has a feed unit 103 arranged on it, carrying a drilling machine 104. The drilling machine 104 is displaceable along the feeder 103 to further increase the reach/maneuverability during drilling.

As noted above, rock drilling at low gallery height places higher demands on the configuration of the rig and the use of a rig according to FIG. 1 in low or narrow galleries has the drawback that, because of the extension of the boom in the longitudinal direction, maneuvering/transportation can be hard to do without the boom 102 and/or the drilling machine 104 hitting the surrounding rock, resulting in unwanted damage.

Figure 2:
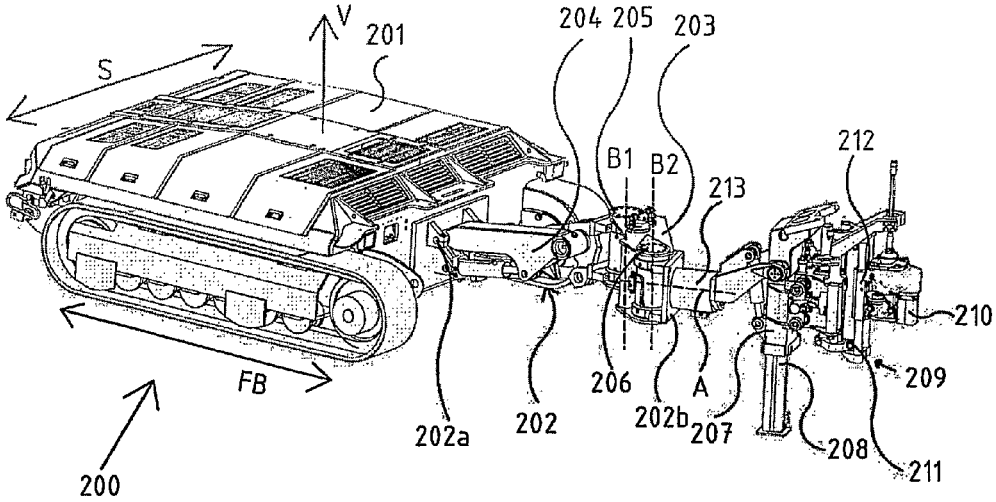
FIG. 2 shows a rock drilling rig outfitted with a boom according to the present invention.

The invention solves this problem with a boom, as shown in FIG. 2, for a mining and/or construction machine, such as a rock drilling rig.

The rock drilling rig 200 in FIG. 2 is especially suited to drilling and/or bolting in very low and/or confined galleries. For example, there are galleries with a height in the order of 1.2 m, where not only does rock (ore) need to be mined, but also one has to do bolting with bolt lengths exceeding the gallery height, to reduce the risk of for example a cave in.

The rock drilling rig 200 shown consists of a carrier 201 and a boom 202, whose one end 202*a* is attached to the carrier. Unlike the boom 102 of FIG. 1, however, the boom 202 does not consists of a single elongated section, but rather two boom sections, a first boom section 203 and a second boom section 204, which are joined by a first rotational linking means 205 with an axis of rotation B1, whose function will be explained further below.

A carrier 201 of the type in FIG. 1 is usually controlled not by an operator on board the carrier 201 (due to the relatively small size of the carrier), but instead the rock drilling rig 200 can be controlled remotely by an operator at a suitable control unit, which can be connected to the drilling rig by a cable, for example, or a wireless interface.

Moreover, the carrier has forward/backward (longitudinal) directions FB and side directions S, and a vertical direction V, orthogonal to the directions FB, S. Thus, the vertical direction is perpendicular to the base of the carrier, at least while it is flat. This also means that the carrier's vertical direction is not necessarily coincidental with the "true" vertical direction, e.g., in the cases when the base is not horizontal. Therefore, in this specification, the term "carrier's vertical direction" means a vertical direction as above.

The carrier 201 is moreover provided as usual with functions required by the rock drilling rig, such as control units and hydraulic pumps to drive the boom/drilling support/feed arrangement/drilling machine. The carrier can also have devices to operate said hydraulic pump(s), such as for example an internal combustion engine and/or electric motor, which can be operated by connection to appropriate electrical mains.

At the other end 202*b* of the boom 202, away from the carrier 201, a drilling support 207 with support leg 208 is arranged via a second rotational linking means 206 with axis of rotation B2. To the support 207 is fastened a feeding arrangement 209, carrying a drilling machine 210 and providing for displacement of the drilling machine 210 relative to a feed holder secured to the drilling support by a feed beam 211, and a carriage 212 displaceable along the feed beam 211. The specific operation of the feed arrangement is not significant to the present invention, and therefore is shown only schematically in FIG. 2.

The rotational linking means 205, 206 and thus the axes of rotation B1, B2 are fixed in relation to each other, i.e., they cannot twist relative to each other. Moreover, the axes of rotation B1, B2 in the figure are shown as essentially vertical, but this is not necessarily so, and when said boom arrangement is fastened to said carrier they can also form other angles (fixed in relation to each other), as long as these angles are in the interval of 0-45° from the carrier's vertical axis V as defined above.

For better comprehension of the feeding arrangement shown in FIG. 2, refer to the parallel Swedish patent application with the same filing date, entitled "Feed unit", applicant Atlas Copco Rock Drills AB and inventor Sven-Olov Nyström. However, the feed arrangement shown in FIG. 2 is only one example, and other types of feed units can be connected to a boom according to the invention.

The feed unit/drilling support is attached to the boom at a third rotational linking means 213 to allow drilling not only in an upward direction, as shown, but in any radial direction looking from the axis A of the third rotational linking means 213.

Figure 4A:
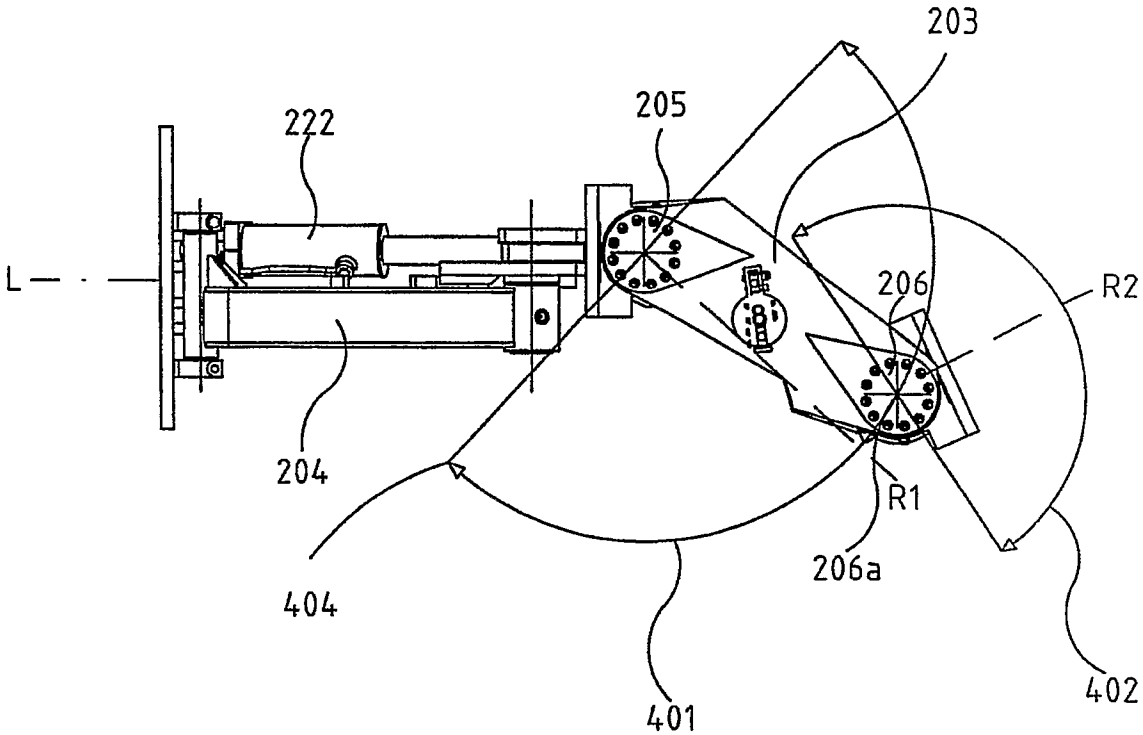
FIG. 4*a* shows the steering range for the rotational link arranged at the first boom section shown in FIG. 3.
Figure 4B:
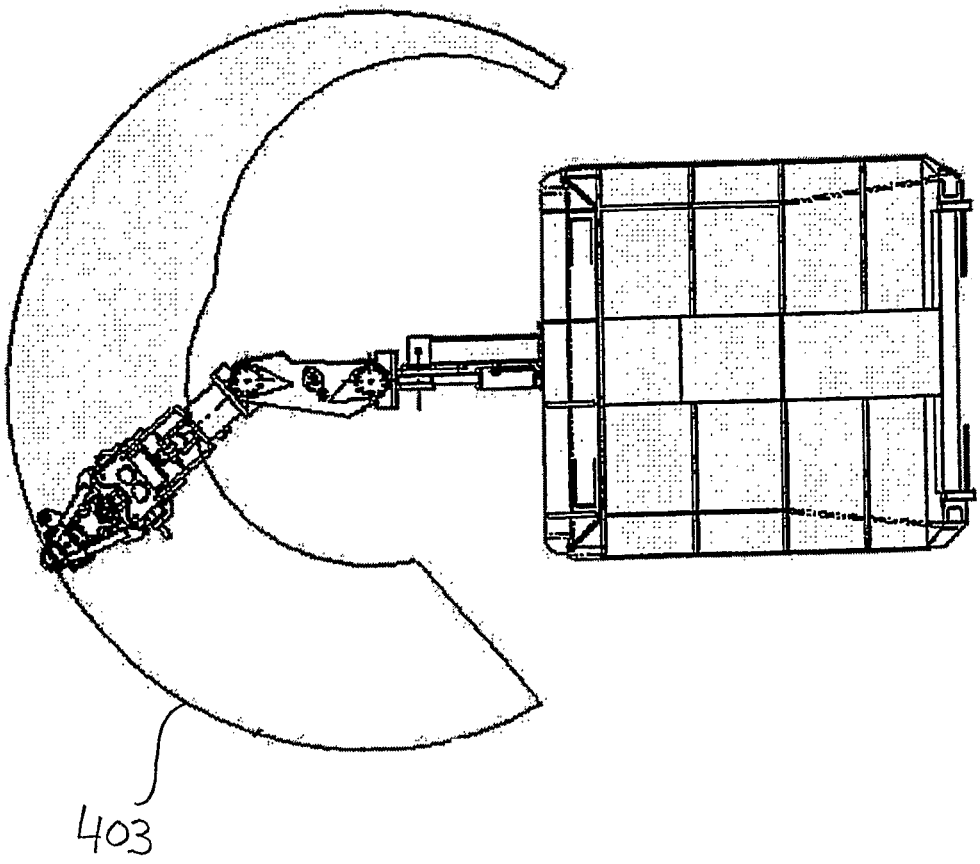
FIG. 4*b* shows the drilling/bolting coverage area for the rock drilling rig shown in FIG. 2.

The boom 202 of the invention has the advantage that it by the first rotational linking means 205 renders the first boom section 203 possible to bend/rotate in relation to the second boom section 204 about the axis of rotation B1, thus allowing the rock drilling rig 200 to be made relatively compact during transport, with the first boom section 203 folded in and thus a feed unit arranged relatively close to the carrier, as shown in FIG. 4*b* below. This has the benefit of substantially facilitating transport in especially narrow or low galleries.

Figure 3:
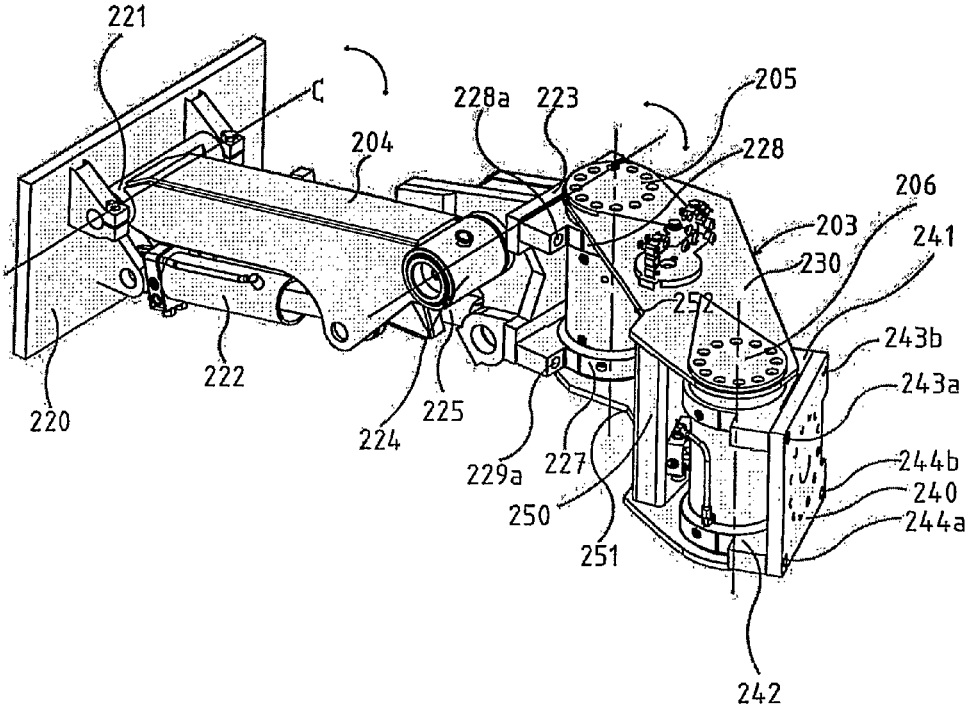
FIG. 3 shows a first boom section for the boom of FIG. 2 in greater detail.

In FIG. 3, the boom of the invention is shown more in detail. As can be seen, said second boom section 204 is secured to the carrier 201 by a fastening plate 220. Moreover, the second boom section is hinged to the carrier by a fourth rotational linking means 221, so that the second boom section 204 can be raised or lowered relative to the carrier about the axis of rotation C of said fourth rotational linking means, at which the raising/lowering of the second boom section is achieved by means of a hydraulic cylinder 222.

The second boom section also has a fastening plate 223 at its end away from the carrier, which is likewise hinged to the second boom section 204 and can rotate relative to the second boom section 204 via a fifth rotational linking means 224, the rotation of said fifth linking means 224 being controlled by a hydraulic cylinder 225 (nearly hidden in the figure). Operation of the hydraulic cylinders 222 and 225 is preferably such that the resulting turning of the linking means 221, 224 are equal and opposite in direction, so that the two fastening plates 220, 223 are held parallel all the time.

Moreover, the first boom section 203 is secured to the fastening plate 223 by the rotational linking means 205 at the first end of the first boom section 203 by fastening devices 227, 228, arranged about the rotational linking means 205, and secured by suitable means, such as screw/bolt joint, to the fastening plate 223, e.g., at fastening points 228*a-b*, 229*a-b* (fastening points 228*b*, 229*b* are hidden by the rotational linking means 205).

The fastening devices 227, 228 are fastened and in the rotational direction locked to the rotational linking means 205, so that the first boom section 203 can rotate via the rotational linking means 205 relative to the second boom section 204.

In corresponding manner, a fastening plate 240 is attached to the rotational linking means 206 placed at the end of the first boom section away from the second boom section by fastening devices 241, 242 placed around the rotational linking means 206, and which in corresponding manner to the above is fastened to the fastening plate 240 at fastening points 243*a-b*, 244*a-b*. The fastening devices 241, 242 are locked to the rotational linking means 206 so as to follow along with its turning. Thus, the fastening plate 240 and the units attached to the fastening plate 240 can turn in relation to the first boom section 203.

As shown in FIGS. 2 and 3, drilling support 207 and feed unit 209 are attached to the boom (the first boom section) via the fastening plate 240 (via the third rotational linking means 213).

Figure 6:
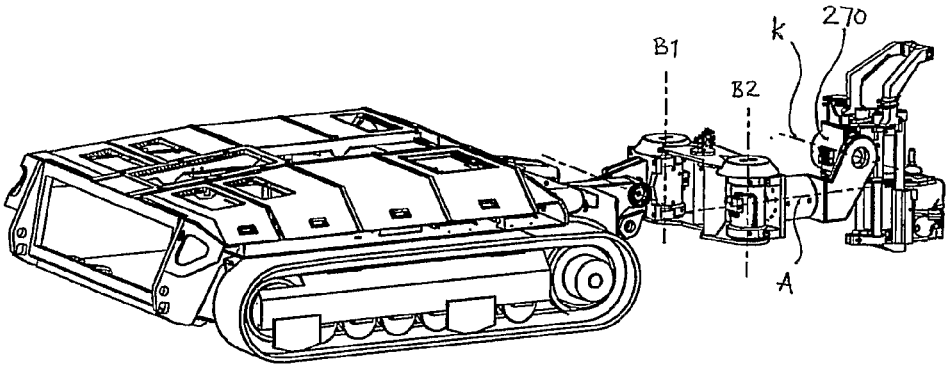
FIG. 6 shows a rock drilling/bolting rig in operational position provided with a rotational linking means for attachment of a drilling/bolting machine so that it can slant toward a boom arrangement in the direction of movement of the rig.
Figure 7:
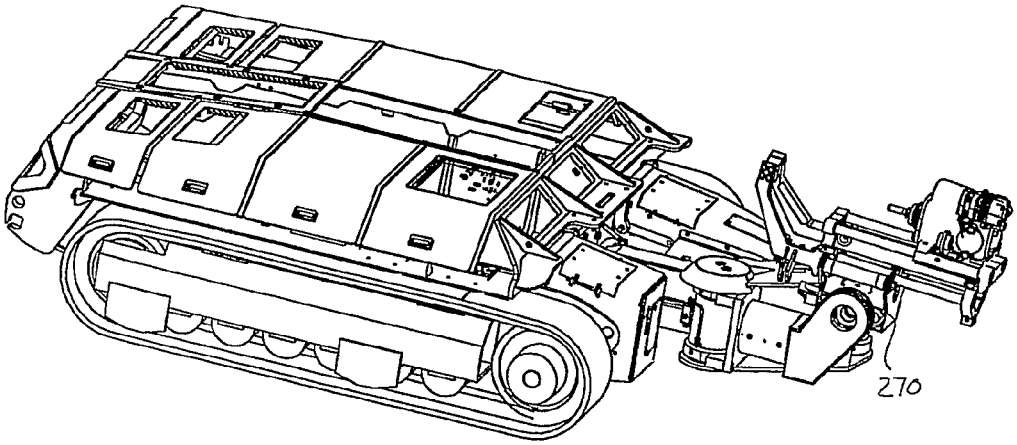
FIG. 7 shows the rock drilling/bolting rig of FIG. 6, but in the transport position.

In FIG. 2, it is shown that the feed unit is attached able to angle relative to the rotational linking means 213. FIG. 2 shows how this angling can be done with the help of a cylinder. Further advantageous embodiments of this ability to angle relative the rotational linking means 213 are shown in FIGS. 6 and 7, where a rotational linking means with axis of rotation K is shown. This rotational linking means can as a control unit have an el- or fluid driven motor such as a hydraulic motor or electromotor. FIG. 6 shows a typical drilling position, while FIG. 7 shows a typical transportation position. However, an operational position (drilling or bolting) can also occur with the rotational linking means 270 in other angles around the axis of rotation K. A solution according to FIGS. 6 and 7 provides great flexibility regarding adjusting the drilling/bolting at the same time as great compactness during transportation is achieved. Moreover, it is advantageous if the rotational linking means 270 is able to turn around the axis K within the interval of 0 to at least 135 degrees. If the design is made for 0 to 180 degrees, forward drilling can occur at the same time as the possibility of transport with the drilling unit pointing backward is maintained.

Overall, the solution of the invention allows the feed unit/drilling support to move with very great freedom relative to the carrier 201, both to make the boom and feed unit as compact as possible during transportation at the same time as a very great freedom of adjustment during drilling is obtained.

This is exemplified by FIG. 4*a*, where the boom of FIG. 3 is shown from above, and the adjustment range of the first boom section 203 and the second fastening plate 240 is shown schematically by arrows 401, 402. As can be seen in the Figure, the two rotational linking means 205, 206 have a turning range of basically ±90° relative to reference angles R1, R2.

As can also be seen, the reference angles R1, R2 are not parallel to each other, and neither of the reference angles R1, R2 is parallel to the longitudinal axis of the carrier. This means that the working range of the rigs becomes somewhat asymmetrical with respect to the carrier's longitudinal direction L, as shown schematically in FIG. 4*b*, where the drill rig is shown from above with peripheral line 403 showing possible positions in which the feed unit can be adjusted for drilling.

Figure 4C:
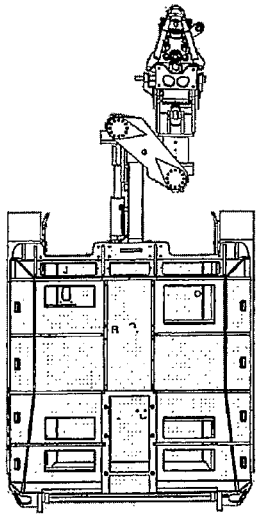
FIG. 4*c* shows schematically one transport position for boom and feed arrangement for the rock drilling rig shown in FIG. 2.

However, the asymmetry in control of the respective rotational linking means has the benefit that boom and drilling support/feed unit in transport can be arranged in a very space-saving manner, since the outer rotational linking means 206 (centre of rotation 206*a*) can turn by the inner rotational linking means 205 to the point 404 in FIG. 4*a*. Then through turning also the drilling support/feed unit in with the outer rotational linking means, a very compact transportation position is achieved, considerably reducing the risk of hitting the surrounding rock while moving. The transport position is shown schematically in FIG. 4*c*. As can be seen, the rotational linking means 206 can be moved to a position which is closer to the carrier, in the longitudinal direction of the carrier, than the position for the rotational linking means 205. Using the boom's pneumatic cylinder 222, furthermore, the entire assemblage can be lifted slightly from the base to further reduce the risk of collision during transport. Thus, the present invention provides a very space-saving boom/feed unit arrangement that substantially facilitates transportation of the drilling rig 200, while achieving a very large coverage area (the area within the peripheral line 403 in FIG. 4B), especially for sideways drilling.

Yet it will be noted that the angle control range (range of rotation) of the respective rotational linking means 205, 206 need not necessarily be ±90°, but also other angles are possible. Larger angle ranges offer further adjustment freedom, while smaller ranges limit the adjustment possibilities. The total angle interval for rotational linking means 205, 206 should not be less than 135° (±62.5°).

Figure 5:
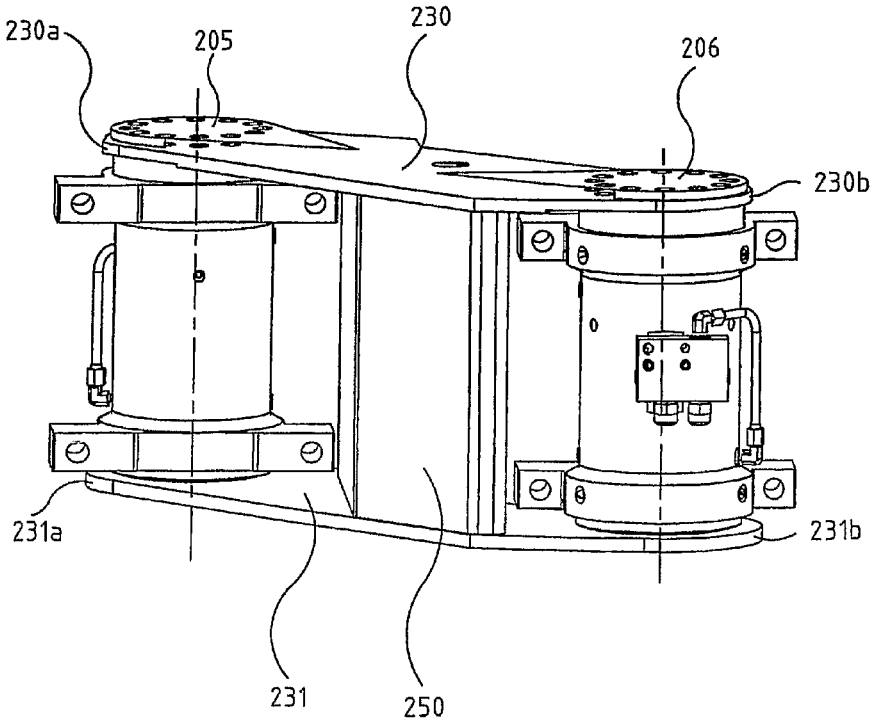
FIG. 5 shows a first boom section according to the invention in greater detail.

The first boom section consists, as shown in FIGS. 3 and 5, of a first and a second essentially platelike element 230 and 231, respectively, said platelike elements being parallel to each other, and the upper ends of the rotational linking means 205, 206 are fastened to respective ends 230*a*, 230*b* of said first platelike element 230, and the lower ends of said rotational linking means are fastened to respective ends 231*a*, 231*b* of said second platelike element.

The rotational linking means 205, 206 is fastened to the platelike element 230 by screw joints, while projecting axial sections on the rotational linking means are pushed into corresponding recesses in the platelike element 231. This allows a simple assembly of the first boom section 203, but also a screw connection can of course be used to secure the rotational linking means to the lower platelike element 231. Moreover, the platelike elements are held together by a reinforcing element 250, besides said rotational elements, and the two platelike elements are attached to it by suitable screw connection, for example. Alternatively, the platelike elements 230, 231 and reinforcement element 250 can make an integrated unit.

As best seen in FIG. 3, the two platelike elements also have recesses 251, 252, to allow the first boom section 203 to come closer to the second boom section 204 without retracting the latter, i.e., the possible angle control is increased.

The invention has been specified above with regard to a specific boom design. Yet the appearance of the boom is not confined to that shown in the figures, but rather can differ from that exemplified in the figures without departing from the invention, as defined in the following claims.

The invention claimed is:

1. Boom arrangement for use in a mining or construction machine, comprising a first boom section with a first end and a second end, wherein said first end is designed to be fastened to a carrier, and said second end is designed to carry a drilling machine, wherein said boom arrangement furthermore comprises a first rotational linking means with a first axis of rotation (B1) and a second rotational linking means with a second axis of rotation (B2), wherein:

said first rotational linking means is arranged at said first end of said first boom section and said second rotational linking means is arranged at said second end of said first boom section such that said axes of rotation (B1, B2) are fixed in relation to each other, and said axes of rotation (B1, B2), when said boom arrangement is fastened to said carrier, make a first and second angle, respectively, with the vertical direction of the carrier, said first and second angles being in the interval of 0 to 45°, wherein said first boom section is designed to carry said drilling machine by a third rotational linking means to enable drilling in any radial direction looking from the axis (A) of the third rotational linking means, wherein said first boom section comprises a first at least partly platelike element arranged at a third angle relative to said first (B1) or second axis (B2) of rotation, wherein at least one of said first and said second rotational linking means is fastened to said first element for maintaining said fixed relation between said axes of rotation, and said third angle is in the interval of 45-90°.

2. Boom arrangement according to claim 1, wherein said first boom section is designed to be fastened to said carrier by a second boom section, while said first boom section is fastened to said second boom section via said first rotational linking means.

3. Boom arrangement according to claim 2, wherein said second rotational linking means, in operation, can move via said first rotational linking means to a position closer, in the carrier's longitudinal direction, to the carrier than the position for said first rotational linking means.

4. Boom arrangement according to claim 2, wherein said first boom section comprises a first at least partly platelike element arranged at a third angle relative to said first (B1) or second axis (B2) of rotation, wherein said first or said second rotational linking means is fastened to said first element and said third angle is in the interval of 45-90°.

5. Boom arrangement according to claim 1, wherein said first (B1) and second (B2) axis of rotation are essentially parallel.

6. Rock drilling rig or rock bolting rig, wherein said rig comprises at least one boom arrangement according to claim 1.

7. Boom arrangement for use in a mining or construction machine, comprising a first boom section with a first end and a second end, wherein said first end is designed to be fastened to a carrier, and said second end is designed to carry a drilling machine, wherein said boom arrangement furthermore comprises a first rotational linking means with a first axis of rotation (B1) and a second rotational linking means with a second axis of rotation (B2), wherein:

said first rotational linking means is arranged at said first end of said first boom section and said second rotational linking means is arranged at said second end of said first boom section such that said axes of rotation (B1, B2) are fixed in relation to each other, and said axes of rotation (B1, B2), when said boom arrangement is fastened to said carrier, make a first and second angle, respectively, with the vertical direction of the carrier, said first and second angles being in the interval of 0 to 45°, wherein said first boom section is designed to carry said drilling machine by a third rotational linking means to enable drilling in any radial direction looking from the axis (A) of the third rotational linking means, said first boom section comprises a first at least partly platelike element arranged at a third angle relative to said first (B1) or second axis (B2) of rotation, wherein at least one of said first and said second rotational linking means is fastened to said first element, and said third angle is in the interval of 45-90°, and wherein said first boom section has a second at least partly platelike element arranged at a fourth angle relative to said first or second axis of rotation, wherein at least one of said first and said second rotational linking means is fastened to said second element, and said fourth angle is in the interval of 45-90°.

8. Boom arrangement according to claim 7, wherein said first or second element extends from said first rotational linking means to said second rotational linking means, while said first and said second rotational linking means is fastened to said first or said second element.

9. Boom arrangement according to claim 8, wherein said first platelike element and said second platelike element are essentially parallel.

10. Boom arrangement according to claim 8, wherein a reinforcement element is arranged between and joined to said first and second at least partly platelike element.

11. Boom arrangement according to claim 8, wherein said first or second at least partly platelike element comprises at least one respective plane surface at said first or second rotational linking means, while said plane surface or plane surfaces are arranged in a plane essentially perpendicular to said first or second axis of rotation, and a first end or a second end of said first or second rotational linking means is fastened to a respective plane surface.

12. Boom arrangement according to claim 7, wherein said first platelike element and said second platelike element are essentially parallel.

13. Boom arrangement according to claim 12, wherein a reinforcement element is arranged between and joined to said first and second at least partly platelike elements.

14. Boom arrangement according to claim 12, wherein said first or second at least partly platelike element comprises at least one respective plane surface at said first or second rotational linking means, while said plane surface or plane surfaces are arranged in a plane essentially perpendicular to said first or second axis of rotation, and a first end or a second end of said first or second rotational linking means is fastened to a respective plane surface.

15. Boom arrangement according to claim 7, wherein a reinforcement element is arranged between and joined to said first and second at least partly platelike elements.

16. Boom arrangement according to claim 7, wherein said first or second at least partly platelike element comprises at least one respective plane surface at said first or second rotational linking means, while said plane surface or plane surfaces are arranged in a plane essentially perpendicular to said first or second axis of rotation, and a first end or a second end of said first or second rotational linking means is fastened to a respective plane surface.

17. Boom arrangement according to claim 16, wherein at least one of said first and second rotational linking means is fastened by respective ends to plane surfaces arranged on said first and second platelike element, said plane surfaces being essentially parallel.

18. Boom arrangement according to claim 7, wherein said first platelike element and said second platelike element are essentially parallel.

19. Boom arrangement for use in a mining or construction machine, comprising a first boom section with a first end and a second end, wherein said first end is designed to be fastened to a carrier, and said second end is designed to carry a drilling machine, wherein said boom arrangement furthermore comprises a first rotational linking means with a first axis of rotation (B1) and a second rotational linking means with a second axis of rotation (B2), wherein:

said first rotational linking means is arranged at said first end of said first boom section and said second rotational linking means is arranged at said second end of said first boom section such that said axes of rotation (B1, B2) are fixed in relation to each other, and said axes of rotation (B1, B2), when said boom arrangement is fastened to said carrier, make a first and second angle, respectively, with the vertical direction of the carrier, said first and second angles being in the interval of 0 to 45°, wherein said first boom section is designed to carry said drilling machine by a third rotational linking means to enable drilling in any radial direction looking from the axis (A) of the third rotational linking means, said first boom section is designed to be fastened to said carrier by a second boom section, while said first boom section is fastened to said second boom section via said first rotational linking means, said first boom section comprises a first at least partly platelike element arranged at a third angle relative to said first (B1) or second axis (B2) of rotation, wherein at least one of said first and said second rotational linking means is fastened to said first element and said third angle is in the interval of 45-90°, and said first boom section has a second at least partly platelike element arranged at a fourth angle relative to said first or second axis of rotation, wherein at least one of said first and said second rotational linking means is fastened to said second element, and said fourth angle is in the interval of 45-90°.

* * * * *